United States Patent [19]

Lindberg

[11] Patent Number: 4,653,593

[45] Date of Patent: Mar. 31, 1987

[54] CONTROL METHOD AND CONTROL DEVICE FOR A DOWN-THE-HOLE ROCK DRILL

[75] Inventor: Eric T. Lindberg, Bromma, Sweden

[73] Assignee: Atlas Copco Aktiebolag, Nacka, Sweden

[21] Appl. No.: 752,453

[22] Filed: Jul. 5, 1985

[30] Foreign Application Priority Data

Jul. 12, 1984 [SE] Sweden ..... 8403686

[51] Int. Cl.[4] ..... E21B 4/14

[52] U.S. Cl. ..... 173/1; 173/4; 173/20; 364/510; 175/296

[58] Field of Search ..... 173/8, 9, 20, 105–107, 173/115, 4; 175/296, 297; 364/505, 510

[56] References Cited

U.S. PATENT DOCUMENTS 3,182,733 5/1965 Wigren ..... 173/115
3,979,944 9/1976 Salmi et al. ..... 173/8
3,995,700 12/1976 Mayer et al. ..... 173/115 X
4,006,783 2/1977 Granholm ..... 173/105 X
4,502,842 3/1985 Currier et al. ..... 364/510 X

FOREIGN PATENT DOCUMENTS 1552975 12/1976 United Kingdom .

*Primary Examiner*—E. R. Kazenske
*Assistant Examiner*—John L. Knoble
*Attorney, Agent, or Firm*—Frishauf, Holtz, Goodman & Woodward

[57] ABSTRACT

When drilling deep boreholes with a down-the-hole drill (15), the pressure and the flow of the motive fluid are controlled so that the impact velocity of the piston hammer of the drill is kept within narrow limits independently of the counter pressure in the borehole. For this purpose the quotient of pressure and flow can be held substantially constant.

11 Claims, 4 Drawing Figures

11
12
13
14
15
16
17
18
19
20
21
22
23
P
Q

CONTROL METHOD AND CONTROL DEVICE FOR A DOWN-THE-HOLE ROCK DRILL

This invention relates to a method of controlling the operation of a pressure fluid operated down-the-hole percussive rock drill when drilling deep boreholes. It also relates to a control device for controlling the operation of a down-the-hole percussive rock drill.

A compressed air operated down-the-hole rock drill is usually designed to make its piston hammer reach the maximum allowable impact velocity when operated with motive air at a defined pressure and when there is no counter pressure outside the drill.

The counter pressure that may arise in the borehole when drilling holes that are only a few tenths of meters deep is so small that it can be neglected. When deep holes are drilled, in particular holes that are several hundred meters deep, the counter pressure will be so great that it must be compensated for. It is known in the art to vary the motive air pressure in accordance with various rules of thumb.

The counter pressure does not change in accordance with any rule but it may change suddenly and irregularly for example due to changes in the inflow of water. There is therefore a risk that the impact velocity of the piston hammer be so high that the life of the piston hammer be reduced drastically.

The impact velocity may also be so low that the drilling efficiency will be considerably reduced. The operator cannot know whether a reduced penetration rate depends on too low an impact velocity or on a change in the rock properties.

It is an object of the invention to permit controlled drilling of deep holes. This is achieved mainly by the features defined by the independent claims.

The invention will be described with reference to the accompanying drawings.

Figures 1, 2:
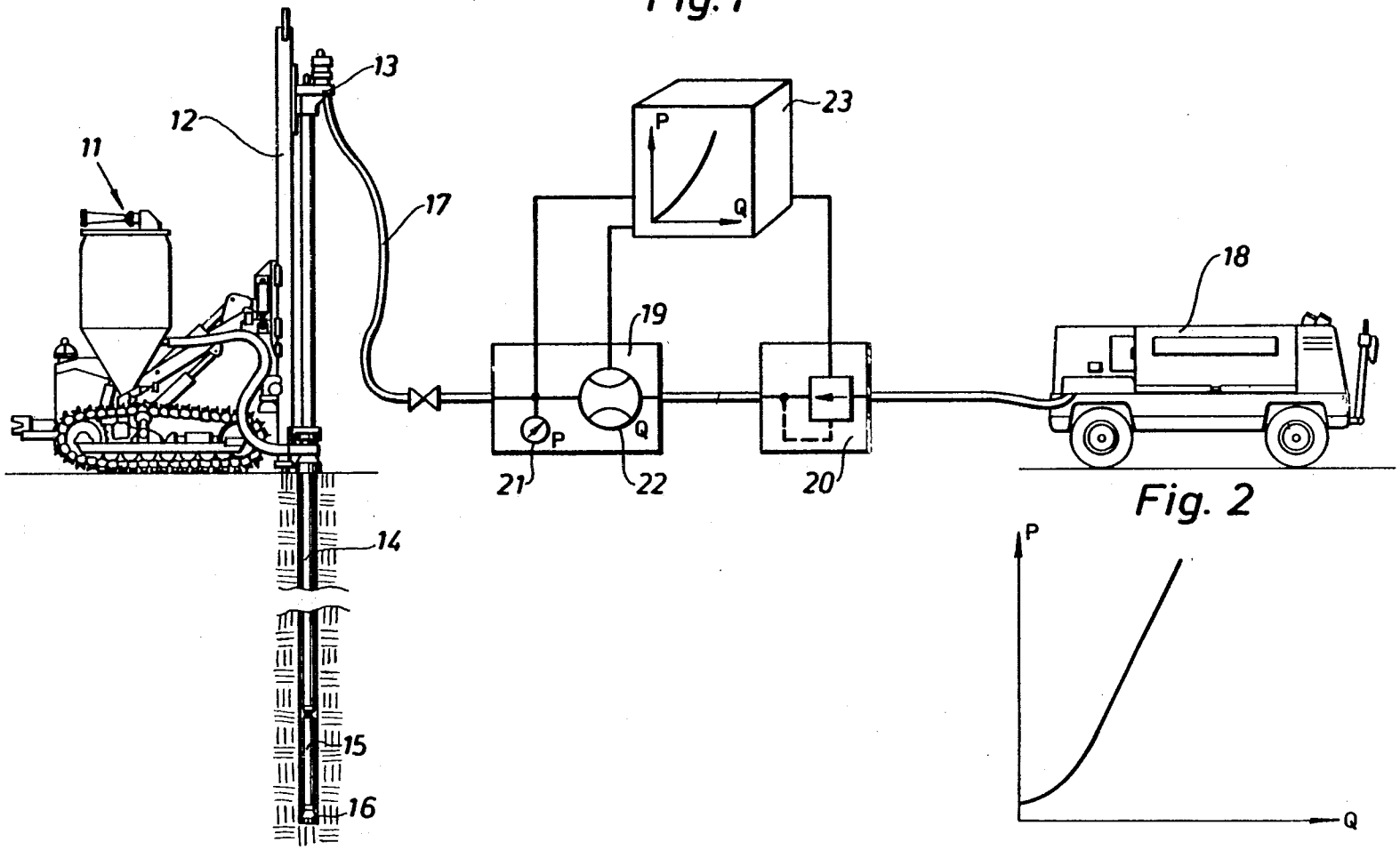
FIG. 1 shows a down-the-hole drill with its drive and control system, the drill being carried by a crawler rig.
FIG. 2 is a diagram on the pressure and flow of the motive fluid.
Figure 3:
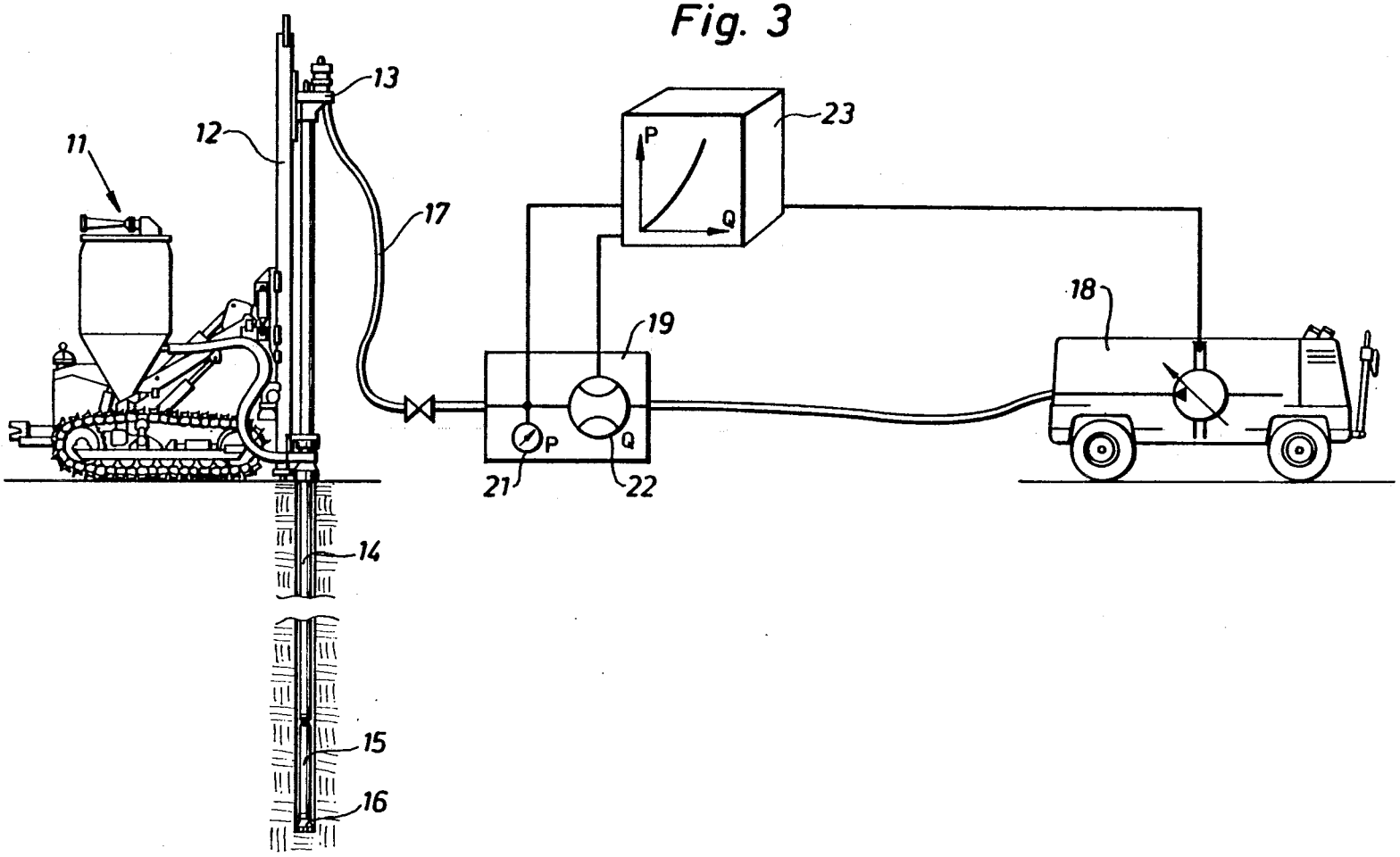

FIG. 3 corresponds to FIG. 1 but shows an alternative drive and control system.

Figure 4:
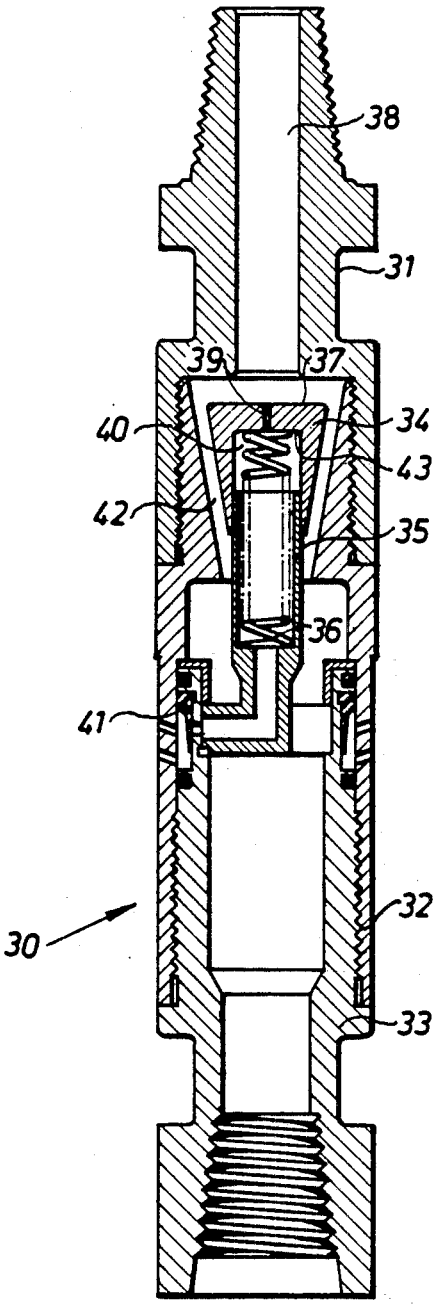

FIG. 4 is a longitudinal section through a top sub for a down-the-hole drill, the top sub being a self contained regulator for the motive fluid.

In FIG. 1, a crawler rig 11 has a feed beam or mast 12 along which a drive unit 13 is axially movable to rotate and feed a drill tube 14 which is made up of tube lengths which are screwed together. A down-the-hole percussive rock drill 15 is mounted to the lower end of the drill tube 14. The down-the-hole drill is not shown in detail, but it can for example be of the kind shown in GB-A No. 1552975. It has a piston hammer that delivers impact to a drill bit 16 either directly or through an anvil block. The entire drill 15 and its drill bit 16 rotate with the drill tube 14 and motive air is supplied to the drill 15 through the drill tube 14 from a hose 17 that is coupled to the drill tube by means of a non-illustrated swivel.

In the hose 17 that leads from a source of compressed air in the form of a compressor 18 there are a sensing unit 19 and a pressure regulator 20. The sensing unit 19 has a pressure gauge 21 and a flow meter 22 both of which are coupled to a control unit 23. The control unit 23 is coupled to control the pressure regulator 20. The control unit 23 comprises a computer and suitable output means. In a laboratory, one can determine a curve of the necessarey pressure of the motive fluid as a function of the air flow, as free air, that gives a constant impact velocity when the drill is subject to various counter pressure. Such a curve shown in FIG. 2. The determined function can be programmed in the control unit 23 and the control unit 23 will then control the pressure regulator 20 so that, with a reasonable accurateness, the point of operation will always follow the curve that has been experimentally determined. The intended impact velocity can for example be 10–11 m/s and the actual impact velocity can be kept within a range of variation of 2 m/s or 1 m/s. The interval can be even narrower.

The drill tube might offer such a restriction that the pressure drop therein should be compensated for. In that case the number of drill tube lengths that make up the drill tube must be an input parameter to the control unit. The input of this input parameter can be manually or automatically carried out. Since the drill tube might be several hundred meters long, it forms a considerable accumulator volume and the drill tube can advantageously be provided with check valves at regular intervals. There could for example be a check valve every 20 meter or every 50 m or at any other desired interval. Then the drill will operate on the accumulator volume in the drill tube while another drill tube length is being added. Thus the flushing air flow will not be interrupted which is a great advantage. The adding of a tube length does not take long and there will still be pressure in the drill tube when the drilling is resumed.

If the actual point of operation is to the right of the curve in FIG. 2, the impact velocity of the piston hammer will be higher than intended and its life can be drastically reduced. If the actual point of operation is to the left of the curve, the impact velocity of the piston hammer will be lower than intended and the penetration rate will be lower than it could be.

As an example it can be mentioned that when a 18 bar drill is used, the pressure supplied to the drill tube can vary from 18 bar at a few meters depth to for example 50 bar at 700 m and 80 bar at 1000 m.

In FIG. 3, a modified drive and control system is shown in which the control unit 23 directly regulates the unloading pressure of the compressor 18, that is, the pressure that the compressor delivers.

Instead of an automatic control as described, the pressure regulator 20 in FIG. 1 and the compressor 18 in FIG. 3 can be manually controlled so that the relation between pressure and flow will follow the curve.

A constant impact velocity is not always desired. If it is desirable to indicate changes in the rock properties, then a control curve or function for constant impact output should be used. Then, a difference in penetration rate will indicate a change in the rock properties. Thus, one will have the possibility to take test samples of the rock only when the rock properties have changed and one will also be reasonably sure of not missing any substantial change in the rock properties.

In the control unit 23, all desired curves or functions can be programmed and one can always control the drilling in a desired way. The control unit can be programmed always to display the actual impact output independently of which curve is utilized.

In order to reach a reasonable accuracy, it is not necessary to determine a curve for each individual drill. It will do to test one or a few drills and then use an average curve or function for all similar machines.

The control unit 23 and its programming have not been described in detail since such details would be apparent to one skilled in the art.

In FIG. 4, a top sub 30 is shown which is to be mounted on top of the drill 15 and coupled to the drill tube. It comprises a housing in three parts 31, 32, 33 which are screwed together. It contains a valving element 34 which is guided on a tube 35 that is fixed to the housing. The tube 35 is biassed open by means of a spring 36. The upper surface 37 of the valving element 34 is subject to the pressure of the motive air in the supply passage 38 and air leaks through a restricted channel 39 into the interior chamber 40 of the valve and acts on the surface 43 of the valving element 34. The pressure in this chamber 40 is substantially the same as the pressure in the borehole outside of the drill 15 since the chamber 40 is vented to the borehole through an annular check valve 41 of rubber.

Thus, the valving element 34 is subject to the motive air which tends to move the valving element downwardly, that is, tends to reduce the annular slot 42 between the valving element 34 and the housing and restrict the supply of motive fluid to the drill 15. The valving element 34 is subject to the counter pressure in the borehole which pressure in the chamber 40 tends to move the valving element upwardly as does the spring 36. The valving element 34 is also subject to dynamic forces. All these forces balance the valving element 34 to vary the slot 42 in a desired way.

The form of the valving element 34 and the characteristics of the spring 36 can be chosen so that the pressure and flow at the inlet of the drill follow a desired curve as described with reference to FIGS. 1–3. In particular it can be formed to deliver a fluid with such a pressure that the quotient between the motive air pressure and the counter pressure will be substantially constant. When there is a considerable counter pressure, the quotient between the pressures at the inlet of the drill and outside the drill should be approximately constant in order to effect a constant impact velocity.

Alternatively to being mounted directly on the drill 15 as described, the top sub 30 can be inserted some drill tube lengths away from the drill 15, for example up to 20 m away. Then, the periodic fluctuations in the flow across the valving element 34 will be reduced which might be an advantage.

I claim:

1. Method of controlling the operation of a compressed air operated dow-the-hole percussive rock drill when drilling deep boreholes by the use of a piston hammer, comprising:

controlling the compressed air supplied to said drill by causing the point of operation in a pressure-flow diagram to follow a predetermined curve; and deriving said curve to provide compensation of ambient counter pressure by maintaining the impact velocity of the piston hammer within a relatively narrow range about an intended impact velocity.

2. Method according to claim 1, including maintaining the impact velocity within a range of 2 m/s.

3. Method according to claim 1, including maintaining the impact velocity within a range of 1 m/s.

4. Method according any one of claims 1, 2 and 3, including metering the pressure and flow of the drive fluid before the drive fluid is supplied to the drill tube and regulating the pressure before the drive fluid is supplied to the drill tube.

5. Method according to claim 4, including compensating for the restriction of the drill tube that conveys the pressure fluid to the drill.

6. A control device for a drive system of a percussive, compressed air operated down-the-hole rock drill which system includes a conduit leading from a source of compressed air to a piston hammer associated with the drill, comprising:

a pressure guage;

a flow meter; and a control unit coupled to said pressure guage and to said flow meter and including means for controlling the pressure of the compressed air, said control unit being programmable to control the air pressure of said compressed air so that the ratio between air pressure and air flow follows a predetermined curve and deriving said curve to provide compensation of ambient counter pressure by maintaining the impact velocity of the piston hammer within a relatively narrow range about an intended impact velocity.

7. Method of controlling the operation of a compressed air operated down-the-hole percussive rock drill when drilling deep boreholes by the use of a piston hammer, comprising:

controlling the compressed air by causing the point of operation in a pressure-flow diagram to follow a predetermined curve;

maintaining the impact velocity of the piston hammer within a relatively narrow range about an intended impact velocity; and deriving the predetermined curve to provide a constant impact energy of the piston hammer.

8. Method of controlling the operation of a compressed air operated down-the-hole percussive rock drill when drilling deep boreholes by the use of a piston hammer, comprising:

controlling the compressed air by causing the point of operation in a pressure-flow diagram to follow a predetermined curve;

maintaining the impact velocity of the piston hammer within a relatively narrow range about an intended impact velocity;

deriving the predetermined curve for at least one of a number of like drills; and employing the other ones of said like drills while following the derived curve.

9. Method according to claim 8, including deriving the predetermined curve to provide a constant impact energy of the piston hammer.

10. Method according to claim 8, including compensating for the restriction of the drill tube that conveys the pressure fluid to the drill.

11. A control device for a drive system of a percussive, compressed air operated down-the-hole rock drill which system includes a conduit leading from a source of compressed air to a piston hammer associated with the drill, comprising:

a pressure guage;

a flow meter;

said conduit comprising a drill tube and a first conduit leading to the upper end of said drill tube, said drill being mounted to the lower end of said drill tube, said pressure guage and said flow meter being coupled to sense the pressure and flow, respectively, of the compressed air in said first conduit; and a control unit coupled to said pressure guage and to said flow meter and including means for controlling the air pressure of the compressed air supplied to said drill tube via said first conduit, said control unit being programmable to control the air pressure of said compressed air so that the ratio between air pressure and air flow follows a predetermined curve and the impact velocity of the piston hammer is maintained within a relatively narrow range about an intended impact velocity.

* * * * *